US010090646B2

(12) United States Patent
Takaoka et al.

(10) Patent No.: US 10,090,646 B2
(45) Date of Patent: Oct. 2, 2018

(54) SPARK PLUG

(71) Applicant: NGK SPARK PLUG CO., LTD., Nagoya-shi, Aichi (JP)

(72) Inventors: Katsuya Takaoka, Ichinomiya (JP); Kazuhiro Kurosawa, Komaki (JP); Kuniharu Tanaka, Komaki (JP); Hisashi Kozuka, Ichinomiya (JP); Toshitaka Honda, Nagoya (JP); Hirokazu Kurono, Nagoya (JP); Haruki Yoshida, Tajimi (JP); Hironori Uegaki, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/315,581

(22) PCT Filed: Jun. 2, 2015

(86) PCT No.: PCT/JP2015/002786
§ 371 (c)(1),
(2) Date: Dec. 1, 2016

(87) PCT Pub. No.: WO2015/198535
PCT Pub. Date: Dec. 30, 2015

(65) Prior Publication Data

US 2017/0214219 A1 Jul. 27, 2017

(30) Foreign Application Priority Data

Jun. 24, 2014 (JP) ..... 2014-128893

(51) Int. Cl.
*H01T 13/05* (2006.01)
*H01T 13/41* (2006.01)
*H01T 21/02* (2006.01)

(52) U.S. Cl.
CPC ..... *H01T 13/05* (2013.01); *H01T 13/41* (2013.01); *H01T 21/02* (2013.01)

(58) Field of Classification Search
CPC ..... H01T 13/05; H01T 13/41; H01T 21/02
(Continued)

(56) References Cited

U.S. PATENT DOCUMENTS 4,713,582 A 12/1987 Yamada et al. ..... 315/58
5,514,314 A 5/1996 McDougal ..... 264/61
(Continued)

FOREIGN PATENT DOCUMENTS

JP S57-055082 A 4/1982 ..... H01T 13/00
JP S61-230281 A 10/1986 ..... H01C 7/00
(Continued)

OTHER PUBLICATIONS

International Search Report issued in corresponding International Patent Application No. PCT/JP2015/002786, dated Sep. 8, 2015.

*Primary Examiner* — Christopher Raabe
(74) *Attorney, Agent, or Firm* — Kusner & Jaffe

(57) ABSTRACT

Disclosed is a spark plug capable of suppressing high-frequency noise by improving the material of an electrical connection part between a center electrode and a metal terminal within an axial hole of an insulator. A spark plug has an electrical connection part arranged in an axial hole of an insulator to establish electrical connection between a center electrode and a metal terminal. The electrical connection part includes a conductor having a first crystal phase formed of a Fe-containing oxide and a second crystal phase formed of a conductive metal oxide of perovskite crystal structure.

6 Claims, 8 Drawing Sheets

(58) Field of Classification Search
USPC ..... 313/143
See application file for complete search history.

(56) References Cited

U.S. PATENT DOCUMENTS

| | | | | |
|---|---|---|---|---|
| 6,160,342 | A | 12/2000 | Nishikawa et al. | 313/141 |
| 9,595,814 | B2 * | 3/2017 | Kasashima | F02P 11/00 |
| 9,627,857 | B2 * | 4/2017 | Sumoyama | C22C 5/04 |
| 2009/0016409 | A1 * | 1/2009 | Mizoguchi | C01G 45/125<br>374/185 |
| 2010/0052497 | A1 | 3/2010 | Walker, Jr. et al. | 313/141 |
| 2016/0329687 | A1 * | 11/2016 | Kasashima | F02P 11/00 |
| 2017/0054274 | A1 * | 2/2017 | Sumoyama | C22C 5/04 |

FOREIGN PATENT DOCUMENTS

| | | | | |
|---|---|---|---|---|
| JP | S62-150681 | A | 7/1987 | H01T 13/20 |
| JP | H02-284374 | A | 11/1990 | F02P 13/00 |
| JP | H11-233232 | A | 8/1999 | H01C 7/00 |
| JP | 2011-159475 | A | 8/2011 | H01T 13/20 |
| JP | 2012-501521 | A | 1/2012 | F02P 13/00 |
| WO | WO 2010/025053 | A2 | 3/2010 | H01T 13/20 |

* cited by examiner

FIG. 4A

| Sample No. | First phase (Fe-containing oxide) | | | Second phase (Perovskite oxide) | | Area ratio S2/(S1+S2) | Presence or absence of resistor 64 | Plug resistance (kΩ) |
|---|---|---|---|---|---|---|---|---|
| | Composition | Average grain size (μm) | Occupation area rate S1 (%) | Composition | Occupation area rate S2 (%) | | | |
| P01 | FeO | 0.8 | 39.5 | $CaMnO_3$ | 58.2 | 0.60 | × | 28 |
| P02 | $(Ni,Zn)Fe_2O_4$ | 2.2 | 68.2 | $SrTiO_3$ | 28.2 | 0.29 | × | 34 |
| P03 | $Fe_2O_3$ | 2.9 | 92.1 | $BaMnO_3$ | 5.1 | 0.05 | × | 26 |
| P04 | $BaFe_{12}O_{19}$ | 26.4 | 78.9 | $MgMnO_3$ | 16.4 | 0.17 | × | 37 |
| P05 | $Fe_3O_4$ | 29.3 | 78.3 | $SrCrO_3$ | 10.5 | 0.12 | × | 27 |
| P06 | $BaFe_{12}O_{19}$ | 26.4 | 78.8 | $LaMnO_3$ | 16.5 | 0.17 | × | 0.8 |
| P07 | $Ba_2Mg_2Fe_{12}O_{22}$ | 25.8 | 83.7 | $LaCrO_3$ | 12.3 | 0.13 | × | 27 |
| P08 | $Ba_2Ni_2Fe_{12}O_{22}$ | 26.2 | 81.9 | $LaCoO_3$ | 13.6 | 0.14 | × | 29 |
| P09 | $NiFe_2O_4$ | 25.5 | 83.4 | $LaFeO_3$ | 10.9 | 0.12 | × | 30 |
| P10 | $Fe_2O_3$ | 25.7 | 82.7 | $NdMnO_3$ | 11.2 | 0.12 | × | 26 |
| P11 | $Y_3Fe_5O_{12}$ | 25.3 | 81.9 | $PrMnO_3$ | 13.2 | 0.14 | × | 0.9 |
| P12 | $(Mn,Zn)Fe_2O_4$ | 25.6 | 82.2 | $YbMnO_3$ | 11.6 | 0.12 | × | 0.8 |
| P13 | $Ba_2Co_2Fe_{12}O_{22}$ | 25.5 | 82.2 | $YMnO_3$ | 10.8 | 0.12 | × | 26 |
| P14 | $BaFe_{12}O_{19}$ | 3.0 | 78.9 | $LaNiO_3$ | 11.1 | 0.12 | × | 28 |
| P15 | $CuFe_2O_4$ | 17.9 | 81.2 | $YbCoO_3$ | 9.2 | 0.10 | × | 29 |
| P16 | $BaFe_{12}O_{19}$ | 8.8 | 55.4 | $YFeO_3$ | 39.2 | 0.41 | × | 26 |
| P17 | $SrFe_{12}O_{19}$ | 25.0 | 76.4 | $NdCoO_3$ | 11.4 | 0.13 | × | 26 |
| P18 | $NiFe_2O_4$, $BaFe_{12}O_{19}$ | 16.8 | 83.7 | $LaMnO_3$ | 12.3 | 0.13 | × | 29 |
| P19 | $BaFe_{12}O_{19}$, $(Mn,Zn)Fe_2O_4$ | 17.2 | 81.1 | $NdCoO_3$ | 10.9 | 0.12 | × | 28 |
| P20 | $(Ni,Zn)Fe_2O_4$, $Ba_2Ni_2Fe_{12}O_{22}$ | 11.8 | 82.7 | $LaSnO_3$ | 10.4 | 0.11 | × | 29 |
| P21 | $Y_3Fe_5O_{12}$, $NiFe_2O_4$ | 20.2 | 83.2 | $PrCoO_3$ | 10.4 | 0.11 | × | 30 |
| P22 | $BaFe_{12}O_{19}$, $(Mn,Zn)Fe_2O_4$ | 19.4 | 86.3 | $LaMnO_3$ | 10.6 | 0.11 | ○ | 1 |
| P23 | $(Ni,Zn)Fe_2O_4$, $(Mn,Zn)Fe_2O_4$ | 19.2 | 82.2 | $LaCoO_3$ | 11.1 | 0.12 | ○ | 12 |
| P24 | $Ba_2Ni_2Fe_{12}O_{22}$, $(Mn,Zn)Fe_2O_4$ | 14.8 | 81.8 | $LaMnO_3$ | 12.9 | 0.14 | ○ | 18 |
| P25 | $(Ni,Zn)Fe_2O_4$, $NiFe_2O_4$ | 18.3 | 86.4 | $PrMnO_3$ | 10.8 | 0.11 | ○ | 25 |

FIG. 4B

| Sample No. | First phase | | | Second phase | | Area ratio S2/(S1+S2) | Presence or absence of resistor 64 | Plug resistance (kΩ) |
|---|---|---|---|---|---|---|---|---|
| | Composition | Average grain size (μm) | Occupation area rate S1 (%) | Composition | Occupation area rate S2 (%) | | | |
| P31 | $Al_2O_3$ | — | — | $CaMnO_3$ | 58.2 | — | × | 32.6 |
| P32 | $Fe_2O_3$ | 0.8 | 82.4 | Cu powder | — | — | × | 34 |
| P33 | $CaCO_3$ | — | 92.1 | Carbon black | 5.1 | — | × | 68 |

(A) INTERCEPT METHOD (B) APPARENT GRAIN SIZE AND AVERAGE GRAIN SIZE

APPARENT GRAIN SIZE $Da(i) = \frac{D1 + D2}{2}$

AVERAGE GRAIN SIZE $Dave = \frac{\Sigma\, Da(i)}{n}$

FIG. 6A

| Sample No. | First phase (Fe-containing oxide) | | Second phase (Perovskite oxide) | Area ratio S2/(S1+S2) | Presence or absence of resistor 64 | Plug resistance (kΩ) | Noise (dB): 30 MHz | | | Noise (dB): 100 MHz | | | Noise (dB): 300 MHz | | |
|---|---|---|---|---|---|---|---|---|---|---|---|---|---|---|---|
| | Composition | Average grain size (μm) | Composition | | | | Initial | Test T1 | Test T2 | Initial | Test T1 | Test T2 | Initial | Test T1 | Test T2 |
| P01 | FeO | 0.8 | $CaMnO_3$ | 0.60 | × | 28 | 73 | 82 | 85 | 69 | 77 | 83 | 64 | 71 | 77 |
| P02 | $(Ni,Zn)Fe_2O_4$ | 2.2 | $SrTiO_3$ | 0.29 | × | 34 | 69 | 78 | 81 | 65 | 73 | 79 | 60 | 67 | 73 |
| P03 | $Fe_2O_3$ | 2.9 | $BaMnO_3$ | 0.05 | × | 26 | 68 | 77 | 80 | 64 | 72 | 78 | 59 | 66 | 72 |
| P04 | $BaFe_{12}O_{19}$ | 26.4 | $MgMnO_3$ | 0.17 | × | 37 | 69 | 78 | 81 | 65 | 73 | 79 | 60 | 67 | 73 |
| P05 | $Fe_3O_4$ | 29.3 | $SrCrO_3$ | 0.12 | × | 27 | 67 | 76 | 79 | 63 | 71 | 77 | 58 | 65 | 71 |
| P06 | $BaFe_{12}O_{19}$ | 26.4 | $LaMnO_3$ | 0.17 | × | 0.8 | 59 | 63 | 67 | 55 | 60 | 63 | 50 | 55 | 57 |
| P07 | $Ba_2Mg_2Fe_{12}O_{22}$ | 25.8 | $LaCrO_3$ | 0.13 | × | 27 | 60 | 65 | 67 | 56 | 60 | 63 | 51 | 55 | 59 |
| P08 | $Ba_2Ni_2Fe_{12}O_{22}$ | 26.2 | $LaCoO_3$ | 0.14 | × | 29 | 60 | 64 | 68 | 56 | 61 | 64 | 51 | 56 | 58 |
| P09 | $NiFe_2O_4$ | 25.5 | $LaFeO_3$ | 0.12 | × | 30 | 61 | 66 | 68 | 57 | 61 | 64 | 52 | 56 | 60 |
| P10 | $Fe_2O_3$ | 25.7 | $NdMnO_3$ | 0.12 | × | 26 | 60 | 65 | 67 | 56 | 60 | 63 | 51 | 55 | 59 |
| P11 | $Y_3Fe_5O_{12}$ | 25.3 | $PrMnO_3$ | 0.14 | × | 0.9 | 61 | 66 | 68 | 57 | 61 | 64 | 52 | 56 | 60 |
| P12 | $(Mn,Zn)Fe_2O_4$ | 25.6 | $YbMnO_3$ | 0.12 | × | 0.8 | 60 | 65 | 67 | 56 | 60 | 63 | 51 | 55 | 59 |
| P13 | $Ba_2Co_2Fe_{12}O_{22}$ | 25.5 | $YMnO_3$ | 0.12 | × | 26 | 60 | 65 | 67 | 56 | 60 | 63 | 51 | 55 | 59 |
| P14 | $BaFe_{12}O_{19}$ | 3.0 | $LaNiO_3$ | 0.12 | × | 28 | 55 | 59 | 63 | 51 | 56 | 59 | 46 | 51 | 53 |
| P15 | $CuFe_2O_4$ | 17.9 | $YbCoO_3$ | 0.10 | × | 29 | 54 | 59 | 61 | 50 | 54 | 57 | 45 | 49 | 53 |
| P16 | $BaFe_{12}O_{19}$ | 8.8 | $YFeO_3$ | 0.41 | × | 26 | 55 | 59 | 63 | 51 | 56 | 59 | 46 | 51 | 53 |
| P17 | $SrFe_{12}O_{19}$ | 25.0 | $NdCoO_3$ | 0.13 | × | 26 | 55 | 60 | 62 | 51 | 55 | 58 | 46 | 50 | 54 |
| P18 | $NiFe_2O_4$, $BaFe_{12}O_{19}$ | 16.8 | $LaMnO_3$ | 0.13 | × | 29 | 43 | 46 | 48 | 38 | 40 | 42 | 34 | 37 | 38 |
| P19 | $BaFe_{12}O_{19}$, $(Mn,Zn)Fe_2O_4$ | 17.2 | $NdCoO_3$ | 0.12 | × | 28 | 42 | 44 | 46 | 37 | 39 | 41 | 33 | 35 | 38 |
| P20 | $(Ni,Zn)Fe_2O_4$, $Ba_2Ni_2Fe_{12}O_{22}$ | 11.8 | $LaSnO_3$ | 0.11 | × | 29 | 43 | 46 | 48 | 38 | 40 | 42 | 34 | 37 | 38 |
| P21 | $Y_3Fe_5O_{12}$, $NiFe_2O_4$ | 20.2 | $PrCoO_3$ | 0.11 | × | 30 | 43 | 45 | 47 | 38 | 40 | 42 | 34 | 36 | 39 |
| P22 | $BaFe_{12}O_{19}$, $(Mn,Zn)Fe_2O_4$ | 19.4 | $LaMnO_3$ | 0.11 | ○ | 1 | 37 | 37 | 37 | 32 | 32 | 32 | 28 | 28 | 28 |
| P23 | $(Ni,Zn)Fe_2O_4$, $(Mn,Zn)Fe_2O_4$ | 19.2 | $LaCoO_3$ | 0.12 | ○ | 12 | 36 | 37 | 36 | 31 | 32 | 32 | 27 | 28 | 28 |
| P24 | $Ba_2Ni_2Fe_{12}O_{22}$, $(Mn,Zn)Fe_2O_4$ | 14.8 | $LaMnO_3$ | 0.14 | ○ | 18 | 36 | 37 | 37 | 31 | 31 | 32 | 27 | 27 | 28 |
| P25 | $(Ni,Zn)Fe_2O_4$, $NiFe_2O_4$ | 18.3 | $PrMnO_3$ | 0.11 | ○ | 25 | 35 | 35 | 35 | 30 | 30 | 30 | 26 | 26 | 26 |

FIG. 6B

| Sample No. | First phase | | Second phase | Area ratio S2/(S1+S2) | Presence or absence of resistor 64 | Plug resistance (kΩ) | Noise (dB): 30 MHz | | | Noise (dB): 100 MHz | | | Noise (dB): 300 MHz | | |
|---|---|---|---|---|---|---|---|---|---|---|---|---|---|---|---|
| | Composition | Average grain size (μm) | Composition | | | | Initial | Test T1 | Test T2 | Initial | Test T1 | Test T2 | Initial | Test T1 | Test T2 |
| P31 | $Al_2O_3$ | — | $CaMnO_3$ | — | × | 32.6 | 88 | 97 | 100 | 84 | 92 | 98 | 79 | 86 | 92 |
| P32 | $Fe_2O_3$ | 0.8 | Cu powder | — | × | 34 | 91 | 100 | 103 | 87 | 95 | 101 | 82 | 89 | 95 |
| P33 | $CaCO_3$ | — | Carbon black | — | × | 68 | 92 | 101 | 104 | 88 | 96 | 102 | 83 | 90 | 96 |

SPARK PLUG

FIELD OF THE INVENTION

The present invention relates to a spark plug.

BACKGROUND OF THE INVENTION

A spark plug for an internal combustion engine generally includes a cylindrical metal shell, a cylindrical insulator arranged in an inner hole of the metal shell, a center electrode disposed in a front end side of an axial hole of the insulator, a metal terminal disposed in a rear end side of the axial hole of the insulator and a ground electrode having one end joined to a front end portion of the metal shell and the other end facing the center electrode to define a spark discharge gap therebetween. It is known to provide a resistor to the spark plug, at a position between the center electrode and the metal terminal within the axial hole, for the purpose of preventing radio noise caused by operation of the engine.

In recent years, there is a demand to increase the discharge voltage of the spark plug for high output performance of the internal combustion engine. However, the increase of the discharge voltage leads to an increase in high-frequency noise that can affect a vehicle electronic control system. It is thus demanded to suppress the occurrence of high-frequency noise during discharge operation of the spark plug.

There has been proposed various techniques to suppress the occurrence of high-frequency noise during discharge operation of the spark plug. For example, Japanese Laid-Open Patent Publication No. 2011-159475 proposes the arrangement of a cylindrical ferrite body as a noise suppression member around a conductor in the spark plug. Japanese Laid-Open Patent Publication No. H02-284374 proposes the arrangement of a wire-wound member in the spark plug.

SUMMARY OF THE INVENTION

The present inventors have found that there is room to improve the material etc. of a conductive electrical connection part between the center electrode and the metal terminal within the axial hole of the insulator for the purpose of effective suppression of high-frequency noise.

The present invention has been made in view of the above circumstances and can be embodied by the following configurations.

(1) According to one aspect of the present invention, there is provided a spark plug, comprising: an insulator having an axial hole formed in an axis direction of the spark plug; a center electrode retained in one end side of the axial hole; a metal terminal retained in the other end side of the axial hole; an electrical connection part arranged in the axial hole to establish electrical connection between the center electrode and the metal terminal; and a metal shell holding therein the insulator, wherein the electrical connection part includes a conductor having a first crystal phase formed of a Fe-containing oxide and a second crystal phase formed of a conductive metal oxide of perovskite crystal structure.

In this spark plug, it is possible to suppress the occurrence of high-frequency noise by the first crystal phase of Fe-containing oxide. It is further possible to stabilize the first crystal phase, without loss of oxygen from the Fe-containing oxide, by the second crystal phase of perovskite-type conductive metal oxide.

(2) In accordance with a second aspect of the present invention, there is provided a spark plug as described above, wherein the conductor may satisfy a relationship of $0.05 \leq S2/(S1+S2) \leq 0.60$ where S1 is an area occupied by the first crystal phase in a cross section of the conductor; and S2 is an area occupied by the second crystal phase in the cross section of the conductor.

In this case, it is possible to preventing excessive increase in resistance by controlling the area ratio S2/(S1+S2) of the first and second crystal phases to be 0.05 or greater. It is also possible to ensure a sufficient high-frequency noise suppression effect of the Fe-containing oxide by controlling the area ratio of the first and second crystal phases to be 0.60 or smaller.

(3) In accordance with a third aspect of the present invention, there is provided a spark plug as described above, wherein the conductive metal oxide of perovskite crystal structure may be of the kind represented by the chemical formula: $ABO_3$ having, as an A-site element thereof, at least one of La, Nd, Pr, Y and Yb.

When the A-site element of the perovskite-type conductive metal oxide is at least one of La, Nd, Pr, Y and Yb, it is possible to effectively suppress initial noise. In addition, it is unlikely that the noise suppression effect will be decreased with time.

(4) In accordance with a fourth aspect of the present invention, there is provided a spark plug as described above, wherein the Fe-containing oxide may have an average grain size of 3.0 μm to 25.0 μm.

When the average grain size of the Fe-containing oxide is in this range, it is possible to attain a larger noise suppression effect.

(5) In accordance with a fifth aspect of the present invention, there is provided a spark plug as described above, wherein the Fe-containing oxide may contain two or more kinds of ferrites.

Due to the fact that a ferrite has a large effect as an inductance component, it is possible to attain a larger noise suppression effect by the use of two or more kinds of ferrites.

(6) In accordance with a sixth aspect of the present invention, there is provided a spark plug as described above, wherein the electrical connection part may further include a resistor containing a conductive material and a glass material; and a resistance between the metal terminal and the center electrode may be in a range of 1 kΩ to 25 kΩ.

In this case, it is possible to attain a larger noise suppression effect because the resistor also has a noise suppression effect.

It is possible to embody the present invention in various forms including, not only a spark plug, but also a manufacturing method of a spark plug, a manufacturing device of a spark plug and a manufacturing system of a spark plug.

BRIEF DESCRIPTION OF THE DRAWINGS

FIG. 4A is a diagram showing the respective configurations of plug samples according to Examples of the present invention.

FIG. 4B is a diagram showing the respective configurations of plug samples according to Comparative Examples.

FIG. 6A is a diagram showing noise measurement results of the plug samples according to Examples of the present invention.

FIG. 6B is a diagram showing noise measurement results of the plug samples according to Comparative Examples.

DETAILED DESCRIPTION OF THE PREFERRED EMBODIMENTS

A. Overall Structure of Spark Plug

Figure 1:
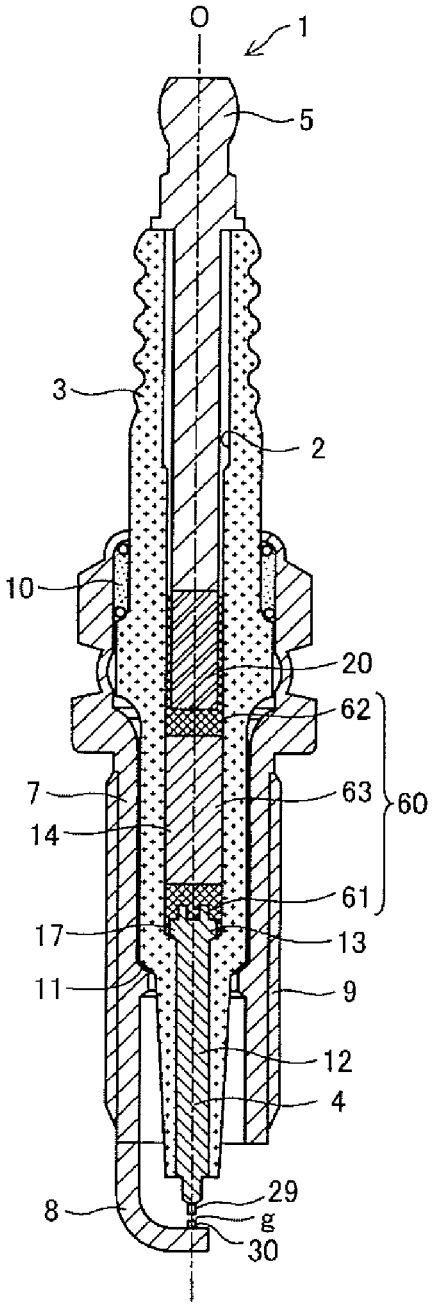
FIG. 1 is a schematic view showing the overall structure of a spark plug according to a first embodiment of the present invention.

FIG. 1 is a schematic view showing the overall structure of a spark plug 1 according to a first embodiment of the present invention. Herein, the bottom side of FIG. 1 (spark discharge side) is referred to a front end side of the spark plug 1; and the top side of FIG. 1 (terminal side) is referred to a rear end side of the spark plug 1. The spark plug 1 includes an insulator 3 having an axial hole 2 formed in the direction of an axis O, a center electrode 4 retained in a front end side of the axial hole 2, a metal terminal 5 retained in a rear end side of the axial hole 2, an electrical connection part 60 arranged between the center electrode 4 and the metal terminal 5 within the through hole 2 for electrical connection of the center electrode 4 to the metal terminal 5, a metal shell 7 holding therein the insulator 3 and a ground electrode 8 having one end joined to a front end face of the metal shell 7 and the other end facing the center electrode 4 with some space left therebetween.

The metal shell 7 is formed into a substantially cylindrical shape to surround and hold therein the insulator 3. A thread portion 9 is formed on an outer circumferential surface of a front end part of the metal shell 7 such that the spark plug 1 can be mounted to a cylinder head (not shown) of an internal combustion engine by means of the thread portion 9.

The insulator 3 is held in an inner circumferential part of the metal shell 7 via a talc 10 and a packing 11. The axial hole 2 of the insulator 3 includes a small-diameter region 12 located at a front end side of the axis O and adapted to retain therein the center electrode 4 and a middle-diameter region 14 made larger in inner diameter than the small-diameter region 12 and adapted to retain therein the electrical connection part 60. A tapered first step portion 13 is formed on a part of the insulator 3 between the small-diameter region 12 and the middle-diameter region 14 so as to increase in diameter toward the rear.

The insulator 6 is fixed in the metal shell 7, with a front end portion of the insulator 3 protruding from the front end face of the metal shell 7. It is preferable that the insulator 3 is made of a material having mechanical strength, thermal strength, electrical strength etc. As such an insulator material, there can be used an alumina-based sintered ceramic material.

A large-diameter flanged portion 17 is formed on a rear end part of the center electrode 4. The center electrode 4 is retained in the small-diameter region 12 by engagement of the flanged portion 17 on the first step portion 13, with a front end of the center electrode 4 protruding from a front end face of the insulator 3, while being kept insulated from the metal shell 7. It is preferable that the center electrode 4 is made of a material having thermal conductivity, mechanical strength etc. As such an electrode material, there can be used a Ni-based alloy material such as Inconel (trade name). A core of high thermal conducting metal material, such as Cu or Ag, may be embedded in the center of the center electrode 4.

The ground electrode 8 is joined at one end thereof to the front end face of the metal shell 7 and bent at a middle portion thereof into a substantially L-like shape such that a distal end portion of the ground electrode 8 faces a front end portion of the center electrode 4 via some space. The ground electrode 8 is made of a material similar to that of the center electrode 4.

Tips 29 and 30 of platinum alloy, iridium alloy etc. are disposed on opposing surfaces of the center and ground electrodes 4 and 8, respectively, so as to define a spark discharge gap g therebetween. Either one or both of these noble metal tips 29 and 30 on the center and ground electrodes 4 and 8 may be omitted.

The metal terminal 5 is adapted to apply a high voltage from an external device to the center electrode 4 for the generation of a spark discharge between the center electrode 4 and the ground electrode 8. In the first embodiment, a front end portion 20 of the metal terminal 5 is formed with an uneven surface. More specifically, an outer circumferential surface of the front end portion 20 is subjected to knurling. By the formation of such a knurled uneven surface on the front end portion 20, the metal terminal 5 can be brought into good contact with the electrical connection part 60 and thereby firmly fixed in the insulator 3. The metal terminal 5 is made of e.g. low carbon steel with a metal plating of Ni etc.

The electrical connection part 60 is arranged between the center electrode 4 and the metal terminal 5 within the axial hole 2 to establish electrical connection between the center electrode 4 and the metal terminal 5. The electrical connection part 60 has a conductor 63 to suppress and prevent the occurrence of radio noise. The electrical connection part 60 also has a first seal layer 61 located between the conductor 63 and the center electrode 4 and a second seal layer 62 located between the conductor 63 and the metal terminal 5. The center electrode 4 and the metal terminal 5 are sealed and fixed in the insulator 3 by these first and second seal layers 61 and 62.

Each of the first and second seal layers 61 and 62 is formed by sintering a seal powder containing a glass powder such as borosilicate soda glass and a metal powder such as Cu or Fe. The resistance of the first and second seal layers 61 and 62 is generally several hundreds mΩ or lower.

As will be discussed later in detail, the conductor 63 includes a conductive substance, a first crystal phase formed of a Fe-containing oxide and a second crystal phase formed of a conductive metal oxide of perovskite crystal structure. By the formation of the first crystal phase of Fe-containing oxide in the conductor 61, it is possible to suppress the occurrence of high-frequency noise during discharge operation of the spark plug. It is further possible to stabilize the first crystal phase, without loss of oxygen from the Fe-containing oxide, by the formation of the second crystal phase of perovskite-type conductive metal oxide. Examples of the preferable compositions of the first and second crystal phases are as follows.

Preferable Composition of First Crystal Phase (Fe-containing Oxide Phase)

For the formation of the first crystal phase in the conductor 63, it is feasible to use a powder of one or more kinds of Fe-containing oxide selected from FeO, $Fe_2O_3$, $Fe_3O_4$ and various ferrites such as Mn—Zn ferrites and Ni—Zn ferrites. Examples of the ferrites are spinel ferrite represented by the chemical formula: $AFe_2O_4$ (where A is at least one kind of element selected from Mn, Co, Ni, Cu, Zn or the like), hexagonal ferrites represented by the chemical formula: $AFe_{12}O_{19}$ or $A_2B_2Fe_{12}O_{22}$ (where A is at least one kind of element selected from Ba, Sr, Pb or the like; and B is at least one kind of element selected from Mg, Co, Ni or the like)

and garnet ferrites represented by the chemical formula: $MFe_5O_{12}$ (where M is at least one kind of rare-earth element such as Y). These ferrites show ferromagnetic properties and each has a large effect as an inductance component.

Preferably, the first crystal phase contains a ferrite. It is particularly preferable that the first crystal phase contains two or more kinds of ferrites. It is possible to attain a larger noise suppression effect by the use of two or more kinds of ferrites due to the fact that the ferrite has a large effect as an inductance component. When two or more kinds of ferrites are used in combination, crystal phases are formed by the respective ferrites. In the case of using two kinds of ferrites: $NiFe_2O_4$ and $BaFe_{12}O_{19}$, for example, there are formed two kinds of crystal phases: one of which is of $NiFe_2O_4$ and the other of which is of $BaFe_{12}O_{19}$. Accordingly, the term "first crystal phase" is defined as including these two kinds of crystal phases. This definition is not limited to the case of using a plurality of ferrites. In the case of using a plurality of kinds of Fe-containing oxides, the term "first crystal phase" is generally defined as including crystal phases of the respective Fe-containing oxides. The "first crystal phase" may be thus also referred to as "Fe-containing oxide phase" in the present specification.

In the first crystal phase, the average grain size of the Fe-containing oxide is preferably in the range of 3.0 μm to 25.0 μm. It has been experimentally demonstrated that, when the average grain size of the Fe-containing oxide is in such preferable range, it is possible to attain a larger noise suppression effect.

Preferable Composition of Second Crystal Phase (Perovskite Oxide Phase)

For the formation of the second crystal phase in the conductor 63, it is feasible to use a perovskite-type conductive metal oxide represented by the chemical formula: $ABO_3$ where the A-site element is a rare-earth element or alkaline-earth metal element; and the B-site element is a transition metal element. Preferably, the A-site element of perovskite-type conductive metal oxide for the formation of the second crystal phase in the conductor 63 is at least one kind selected from the group consisting of La, Nd, Pr, Y and Yb. It has been experimentally demonstrated that, when such a metal element is used as the A-site element, it is possible to effectively suppress initial noise and is unlikely that the noise suppression effect will be decreased with time. In the case of using a plurality of kinds of perovskite-type conductive metal oxides, the term "second crystal phase" is defined as including crystal phases of the respective perovskite-type conductive metal oxides. The "second crystal phase" may be thus also referred to as "perovskite oxide phase" in the present specification.

It is preferable to satisfy a relationship of $0.05 \leq S2/(S1+S2) \leq 0.60$ where S1 and S2 are areas occupied by the first and second crystal phases, respectively, in a cross section of the conductor 63. It is possible to preventing excessive increase in resistance by controlling the area ratio S2/(S1+S2) of the first and second crystal phases to be 0.05 or greater. It is also possible to ensure a sufficient high-frequency noise suppression effect of the Fe-containing oxide by controlling the area ratio of the first and second crystal phases to be 0.60 or smaller. For the determination of the areas S1 and S2, the cross section of the conductor 63 is taken through a direction parallel to the axis O (see FIG. 1).

Figure 2:
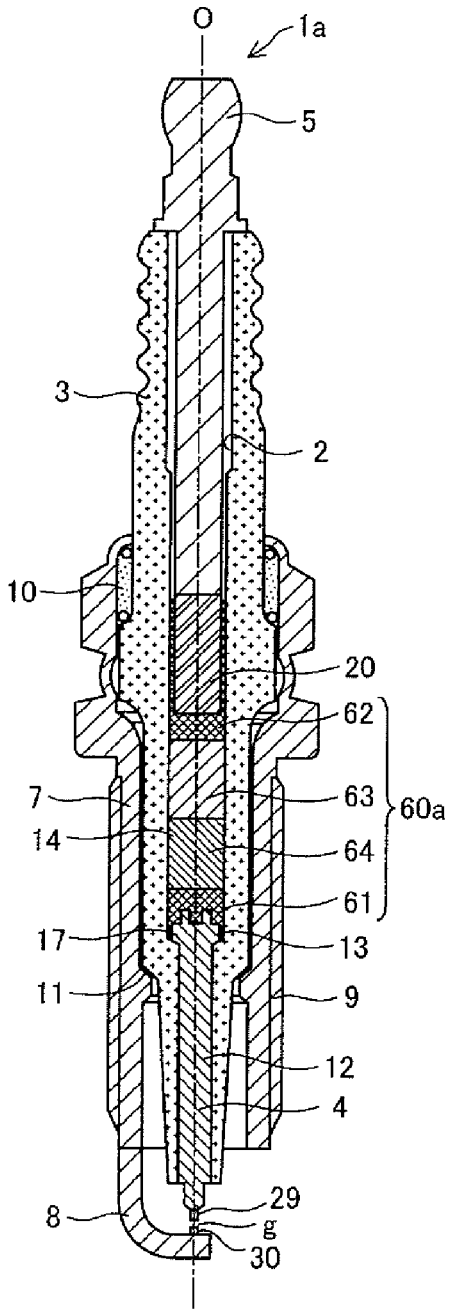
FIG. 2 is a schematic view showing the overall structure of a spark plug according to a second embodiment of the present invention.

FIG. 2 is a schematic view showing the overall structure of a spark plug 1*a* according to a second embodiment of the present invention. The spark plug 1*a* of the second embodiment is different from the spark plug 1 of the first embodiment shown in FIG. 1, in that an electrical connection part 60*a* of the spark plug 1*a* has not only a conductor 63 between first and second seal layers 61 and 62 but also a resistor 64. The other configurations of the second embodiment are the same as those of the first embodiments.

The resistor 64 is formed of a resistive material as prepared by sintering a resistive composition containing a glass powder such as borosilicate soda glass and a conductive powder such as Zn, Sb, Sn, Ag or Ni. Since the resistor 64 also has a noise suppression effect, it is possible to attain a larger noise suppression effect by the combined use of the conductor 63 and the resistor 64.

In the embodiments of FIGS. 1 and 2, either one or both of the first and second seal layers 61 and 62 of the electrical connection part 60 may be omitted. However, these seal layers 61 and 62 are effective to relieve differences in thermal expansion coefficient between the conductor 63 (and the resistor 64) and the metal terminal 5 and between the conductor 63 (and the resistor 64) and the center electrode 4 for stronger connection state. In view of the noise suppression effect, the resistance between the metal terminal 5 and the center electrode 4 is preferably in the range of e.g. 1 kΩ to 25 kΩ. This resistance is a measured value of resistance under the application of a voltage of e.g. 12 V between the metal terminal 5 and the center electrode 4.

B. Formation Process of Electrical Connection Part

Figure 3:
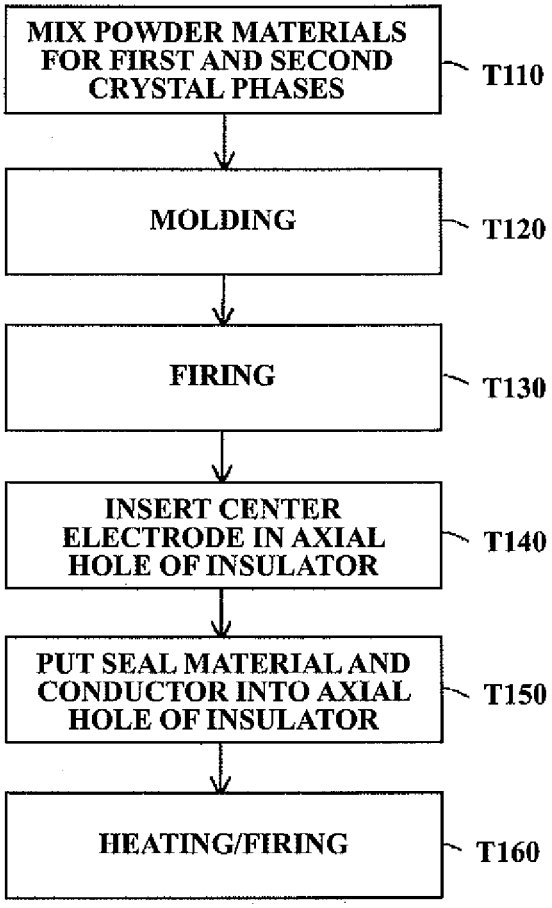
FIG. 3 is a flow chart for a process of forming an electrical connection part in the spark plug.

FIG. 3 is a flow chart for a process of forming the electrical connection part 60 in the spark plug 1 (1*a*).

At step T110, the powder materials for the formation of the first and second crystal phases are weighed and subjected to grinding and mixing. As the powder material for the formation of the first crystal phase, it is feasible to use a powder of one or more kinds of Fe-containing oxide selected from FeO, $Fe_2O_3$, $Fe_3O_4$ and various ferrites is usable. As the powder material for the formation of the second crystal phase, it is feasible to use a powder of one or more kinds selected from various perovskite-type metal oxides and various metal oxides that can be converted to perovskite-type metal oxides by sintering. The grinding and mixing operation is done by e.g. putting the powder materials for the formation of the first and second crystal phases, together with an acetone solvent, an organic binder and a ball of $ZrO_2$, in a resin pot.

At step ST120, the resulting mixed powder is charged into a mold and molded into a cylindrical column shape with the application of a pressure of 30 to 120 MPa.

At step T130, the molded body is fired at 850 to 1350° C. With this, the conductor 63 is obtained.

At step T140, the center electrode 4 is inserted in the axial hole 2 of the insulator 3.

At step T150, the seal material powder for the formation of the first seal layer 61, the conductor 63, the seal material powder for the formation of the second seal layer 62 are charged in this order into the axial hole 2 of the insulator 3 from the rear end side, and then, compacted by insertion of a press pin in the axial hole 2. In the case where the electrical connection part 60*a* is provided with the resistor 64, the powder material for the formation of the resistor 64 is also charged into the axial hole 2 of the insulator 3 at step T150.

At step T160, the metal terminal 5 is inserted in the axial hole 2 of the insulator 3. After that, the whole of the insulator 3 is heated and fired at a predetermined temperature of 700 to 950° C. in a furnace while the charged materials inside the axial hole 2 are pushed by the metal terminal 5 toward the front. As a result, the first and second seal layers 61 and 62 are sintered so that the conductor 63 (and the resistor 64) is sealed and fixed between these seal layers 61 and 62.

After step T160, the insulator 3 in which the center electrode 4 and the metal terminal 5 have been fixed is secured in the metal shell 7 to which the ground electrode 8 has been joined. Finally, the ground electrode 8 is bent such that the distal end portion of the ground electrode 8 is directed toward the center electrode 4. In this way, the spark plug 1 (1*a*) is completed.

EXAMPLES

FIG. 4A is a diagram showing the respective configurations of samples P01 to P25 of the spark plug as Embodiment Examples of the present invention. FIG. 4B is a diagram showing the respective configurations of samples P31 to P33 of the spark plug as Comparative Examples. Each of these samples P01 to P25 and P31 to P33 were produced according to the process of FIG. 3.

The composition, average grain size and occupation area rate S1 of the Fe-containing oxide for the formation of the first crystal phase, the composition, average grain size and occupation area rate S2 of the perovskite-type conductive metal oxide for the formation of the second crystal phase and the area ratio S2/(S1+S2) of the conductor 63 of each sample are shown in FIGS. 4A and 4B. Herein, the average grain size was determined by the after-mentioned intercept method. In the column of "Resistor 64" in FIGS. 4A and 4B, the presence of the resistor 64 is indicated by the symbol "○" (see FIG. 2); and the absence of the resistor 64 is indicated by the symbol "×". Further, the plug resistance (kΩ) refers to the resistance value between the metal terminal 5 and the center electrode 4 of the spark plug 1 (1*a*).

The Fe-containing oxide for the formation of the first crystal phase in each of the samples P01 to P25 of FIG. 4A was selected from the followings: iron oxides such as FeO, $Fe_2O_3$ and $Fe_3O_4$; spinel ferrites such as (Ni, Zn)$Fe_2O_4$, $NiFe_2O_4$, (Mn, Zn)$Fe_2O_4$, $CuFe_2O_4$; hexagonal ferrites such as $BaFe_{12}O_{19}$, $SrFe_{12}O_{19}$, $Ba_2Mg_2Fe_{12}O_{22}$, $Ba_2Ni_2Fe_{12}O_{22}$ and $Ba_2Co_2Fe_{12}O_{22}$; and garnet ferrites such as $Y_3Fe_5O_{12}$.

The perovskite-type conductive metal oxide for the formation of the second crystal phase in each of the samples P01 to P25 of FIG. 4A was selected from the followings: $CaMnO_3$, $SrTiO_3$, $BaMnO_3$, $MgMnO_3$, $SrCrO_3$, $LaMnO_3$, $LaCrO_3$, $LaFeO_3$, $NdMnO_3$, $PrMnO_3$, $YbMnO_3$, $YMnO_3$, $LaNiO_3$, $YbCoO_3$, $YFeO_3$, $NdCoO_3$, $LaSnO_3$ and $PrCoO_3$.

Among the samples P31 to P33 of FIG. 4B, the sample P31 was provided in which the first crystal phase was formed of $Al_2O_3$ without containing a Fe-containing oxide even though the second crystal phase was formed of $CaMnO_3$, that is, one kind of perovskite-type conductive metal oxide. The sample P32 was provided in which the second crystal phase was not present and was replaced with a phase of Cu powder even though the first crystal phase was formed of $Fe_2O_3$. The sample P33 was provided in which the first crystal phase was formed of $CaCO_3$ without containing a Fe-containing oxide; and the second crystal phase was not present and was replaced with a phase of carbon.

The occupation area rates S1 and S2 of the first and second crystal phases were determined by the following method. For each sample, the conductor 63 was formed by the process steps T110 to T130 of FIG. 3. A cross section of the conductor 63 in parallel to the axis O was subjected to mirror polishing and observed with an electron probe micro analyzer (EPMA) to take reflected electron images at 10 fields of view of 200 μm×200 μm. The occupation area rates S1 and S2 of the first and second crystal phases were calculated by analysis of the respective images with the proviso that, in the EPMA analysis, the regions in which Fe (iron) and O (oxygen) were detected were assumed as the first crystal phase and the regions (except the voids) in which O (oxygen) was undetected were assumed as the second crystal phase.

Figure 5:
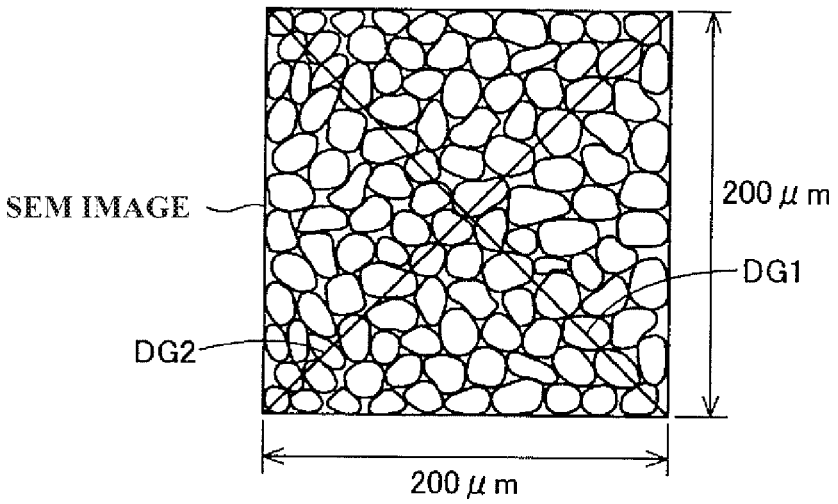
FIG. 5 is a schematic view showing how to determine an average grain size by intercept method.
Figure 5:
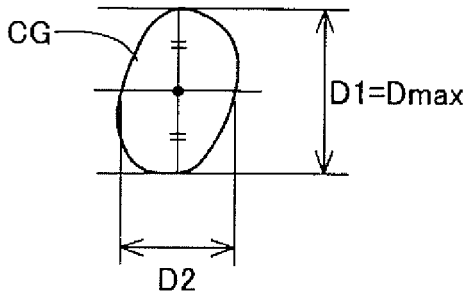

FIG. 5 is a schematic view showing how to determine the average grain size by intercept method. The same polished surface as used for the above EPMA analysis was observed with a scanning electron microscope (SEM) to take images at 10 fields of view of 200 μm×200 μm. FIG. 5(A) shows the state of crystal grains shown in the SEM image. The SEM image was binarized by image analysis software ("Analysis Five" available from Soft Imaging System GmbH). The binarization threshold was set as follows. (1) Among the SEM images, the secondary electron image and the reflected electron image were verified. Then, lines were drawn along dark-colored boundaries (corresponding to grain boundaries) on the reflected electron image so as to specify the positions of the grain boundaries. (2) The reflected electron image was improved by smoothening the reflected electron image while maintaining the edges of the grain boundaries. (3) A graph was obtained from the reflected electron image, with lightness on the horizontal axis and frequency on the vertical axis. The obtained graph had two peaks. The lightness at the midpoint between these two peaks was set as the binarization threshold.

The crystal grains of the first and second crystal phases in the SEM image were distinguished by EPMA analysis. Then, the apparent grain size Da(i) of the crystal grains of the first crystal phase was determined by the following intercept method.

In the intercept method, crystal grains of the first crystal phase were selected such that each of the selected crystal grains intersected at least one of two diagonal lines DG1 and DG2 of the SEM image (see FIG. 5(A)). The maximum diameter Dmax of each selected crystal grain CG was determined as a longer diameter D1 (see FIG. 5(B)). The maximum diameter Dmax of the crystal grain CG refers to the maximum value among outer diameters of the crystal grain CG as measured in all directions. Further, the outer diameter of the crystal grain CG along a straight line passing through the midpoint of the longer diameter D1 and extending perpendicular to the longer diameter D1 was determined as a shorter diameter D2. The average value of the longer and shorter diameters D1 and D2 was calculated. This average value (D1+D2)/2 was determined as the apparent grain size Da(i) of the crystal grain CG. Herein, the expression "(i)" means that the value was of the i-th crystal grain. The average grain size Dave was determined by calculating the average value of the apparent grain sizes Da(i) of the n crystal grains each intersecting at least one of the diagonal lines DG1 and DG2. In the intercept method, some differences occur in the average grain size Dave depending on the SEM images. Thus, the average of the grain size values determined from the respective ten SEM images was used as the crystal grain size Dave.

FIGS. 6A and 6B are diagrams showing noise measurement results of the samples P01 to P25 of FIG. 4A and the samples P31 to P33 of FIG. 4B before and after discharge durability test. In each table, the noise before the discharge durability test is indicated in the column of "Initial"; the noise measured after 200 hours of the discharge durability test in which discharge of the spark plug 1 was performed at a discharge voltage of 30 kV and an ambient temperature of 25° C. is indicated in the column of "Test T1"; and the noise measured after 200 hours of the discharge durability test in which discharge of the spark plug 1 was performed at a discharge voltage of 30 kV and an ambient temperature of 150° C. is indicated in the column of "Test T2". The noise measurement was carried out according to "Motorcycles—Radio Noise Characteristics—Second Part, Measuring Method of Prevention Device, Current Method" of JASO D-002-2 (Japan Society of Automotive Engineers transmission standard D-002-2).

In the noise measurement, high-frequency noise of three frequencies: 30 MHz, 100 MHz and 300 MHz was measured.

The following conclusions are derived from the test results of FIGS. 6A and 6B.

(1) Each of the samples P01 to P25 of Embodiment Examples was provided with the conductor 63 including the first crystal phase of Fe-containing oxide and the second crystal phase of perovskite-type conductive metal oxide. In these samples P01 to P25, the initial noise before the discharge durability test was 73 dB at the most and was not excessively high. Thus, the respective samples had a sufficient noise suppression effect. Since there was not so much increase in noise level even after the discharge durability test, it was possible to maintain the sufficient noise suppression effect.

Further, the area ratio S2/(S1+S2) of the first and second crystal phases was in the range of 0.05 to 0.60 in each of the samples P01 to P25. In this area ratio range, it was possible to prevent excessive increase in resistance. It was also possible to ensure the sufficient high-frequency noise suppression effect of the Fe-containing oxide. It has been shown that the area ratio S2/(S1+S2) is preferably in the range of 0.10 to 0.41, more preferably 0.11 to 0.14.

(2) Among the samples P31 to P33 of Comparative Examples, the samples P31 and P33 in which the first crystal phase of Fe-containing oxide was not included were not favorable in that: the noise of 30 MHz frequency before the discharge durability test was at a high level of 88 dB or more; and the noise level was largely increased after the discharge durability test. Although the first crystal phase of Fe-containing oxide was included in the sample P32, the sample P32 was not favorable in that the noise before the discharge durability test was at a high level of 91 dB. As is seen from comparison between the noise of the sample P32 and the noise of the sample P03, P10, the second crystal phase of perovskite-type conductive metal oxide had a considerably large initial noise suppression effect. Further, the sample P32 was not favorable in that the noise level was largely increased after the discharge durability test. The reason for this is assumed to be that, since the second crystal phase of perovskite-type conductive metal oxide was not included in the sample P32, the Fe-containing oxide was unstable and was deteriorated with time during the discharge durability test. In other words, it is assumed that the noise suppression effect was decreased due to reduction of the Fe-containing oxide ($Fe_2O_3$) to FeO with increase in temperature during the discharge durability test.

(3) Among Embodiment Examples, the samples P06 to P25 in which at least one kind of La, Nd, Pr, Yb and Yb was contained as the A-site element of the perovskite-type conductive metal oxide were more favorable than the samples P01 to P05 in that the noise level before the discharge durability test was lower in the samples P06 to P25 than in the samples P01 to P05. This difference is assumed to be due to the kind of the A-site element. At least one kind of La, Nd, Pr, Yb and Yb was contained as the A-site element of the perovskite-type conductive metal oxide in the samples P06 to P25, whereas any element (Ca, Sr, Ba, Mg) other than the above elements was contained as the A-site element of the perovskite-type conductive metal oxide in the samples P01 to P05. For example, the compositions of the second crystal phases of the samples P04 and P06 were different from each other even though the first crystal phases of the samples P04 and P06 had the same composition $BaFe_{12}O_{19}$. The sample P06 in which the second crystal phase was formed of $LaMnO_3$ was lower in noise level than the sample P04 in which the second crystal phase was formed of $MgMnO_3$. Namely, the sample P6 had a larger noise suppression effect than the sample P04 due to the influence of the A-site element. It is assumed that the other A-site elements (Nd, Pr, Y, Yb) of the samples P06 to P25 had a large noise suppression effect as in the case of La. It has thus been shown that it is preferable to contain at least one of La, Nd, Pr, Y and Yb as the A-site element of the perovskite-type conductive metal oxide.

(4) The samples P14 to P25 in which the average grain size of the Fe-containing oxide of the first crystal phase was in the range of 3.0 μm to 25.0 μm were more favorable, in terms of low noise level, than the samples P01 to P13 in which the average grain size of the Fe-containing oxide of the first crystal phase was smaller than 3.0 μm or greater than 25.0 μm. For example, the samples P06 and P14 were largely different in the average grain size of the first crystal phase even though the compositions of the first and second crystal phases of the samples P06 and P14 were the same. The sample P14 in which the average grain size of the first crystal phase was 26.4 μm was lower in noise level than the sample P06 in which the average grain size of the first crystal phase was 3.0 μm. This difference is assumed to be due to the influence of the average grain size of the first crystal phase. It has been shown that the average grain size of the first crystal phase is preferably in the range of 10.0 μm to 21.0 μm, more preferably 14.0 μm to 20.0 μm.

(5) The samples P18 to P25 in which two kinds of ferrites were used as the Fe-containing oxide of the first crystal phase were more favorable, in terms of low noise level, than the samples P01 to P17 in which one kind of ferrite was used as the Fe-containing oxide of the second crystal phase. For example, the compositions of the second crystal phases of the samples P17 and P19 were the same. The P19 in which the first crystal phase was formed of two kinds of ferrites was lower in noise level than the sample P17 in which the first crystal phase was formed of one kind of ferrite. This difference was assumed to be due to the presence of two kinds of ferrites as an inductance component. It has thus been shown that it is preferable to contain two or more kinds of ferrites in the first crystal phase.

(6) Furthermore, the samples P22 to P25 in which the plug resistance was in the range of 1 kΩ to 25 kΩ were more favorable, in terms of low noise level, than the samples P01 to P21 in which the plug resistance was out of the above range.

The samples P22 to P25 were the most favorable in that, among all of the samples P01 to P25 of Embodiment Examples, the samples P22 to P25 were particularly low in noise level and showed no increase in noise level even after the discharge durability test. In view of these test results of the samples P22 to P25, the most preferable combination of the respective parameter ranges is as follows: [1] the area ratio S2/(S1+S2) of the first and second crystal phases is in the range of 0.11 to 0.14; [2] the A-site element of the perovskite-type conductive metal oxide is at least one of La and Pr; [3] the average grain size of the Fe-containing oxide is in the range of 14.0 μm to 20.0 μm; and [4] the plug resistance is in the range of 1.0 kΩ to 25 kΩ.

C. Modifications

The present invention is not limited to the above specific embodiment and examples and can be embodied in various forms without departing from the scope of the present invention.

Modification 1:

For example, the present invention is applicable to any type of spark plug other than those shown in FIGS. 1 and 2.

DESCRIPTION OF REFERENCE NUMERALS

1, 1*a*: Spark plug
2: Axial hole
3: Insulator
4: Center electrode
5: Metal terminal
7: Metal shell
8: Ground electrode
9: Thread portion
10: Talc
11: Packing
12: Small-diameter region
13: First step portion
14: Middle-diameter region
17: Flanged portion
20: Front end portion
29, 30: Noble metal tip
60, 60*a*: Electrical connection part
61: First seal layer
62: Second seal layer
63: Conductor
64: Resistor
O: Axis

The invention claimed is:

1. A spark plug, comprising:

an insulator having an axial hole formed in an axis direction of the spark plug;

a center electrode retained in one end side of the axial hole;

a metal terminal retained in the other end side of the axial hole;

an electrical connection part arranged in the axial hole to establish electrical connection between the center electrode and the metal terminal; and a metal shell holding therein the insulator, wherein the electrical connection part includes a conductor consisting of a first crystal phase formed of a Fe-containing oxide and a second crystal phase formed of a conductive metal oxide of perovskite crystal structure.

2. The spark plug according to claim 1, wherein the conductor satisfies a relationship of $0.05 \leq S2/(S1+S2) \leq 0.60$ where S1 is an area occupied by the first crystal phase in a cross section of the conductor; and S2 is an area occupied by the second crystal phase in the cross section of the conductor.

3. The spark plug according to claim 1, wherein the conductive metal oxide of perovskite crystal structure is represented by the chemical formula: $ABO_3$ having, as an A-site element thereof, at least one of La, Nd, Pr, Y and Yb.

4. The spark plug according to claim 1, wherein the Fe-containing oxide has an average grain size of 3.0 μm to 25.0 μm.

5. The spark plug according to claim 1, wherein the Fe-containing oxide contains two or more kinds of ferrites.

6. The spark plug according to claim 1, wherein the electrical connection part further includes a resistor containing a conductive material and a glass material; and wherein a resistance between the metal terminal and the center electrode is in a range of 1 kΩ to 25 kΩ.

* * * * *